US005319410A

United States Patent [19]

Glover et al.

[11] Patent Number: 5,319,410

[45] Date of Patent: Jun. 7, 1994

[54] PHOTOGRAPHIC PROCESSING APPARATUS

[75] Inventors: Edward C. T. S. Glover, London; Peter D. Marsden, Middlesex, both of United Kingdom

[73] Assignee: Eastman Kodak Company, Rochester, N.Y.

[21] Appl. No.: 39,252

[22] PCT Filed: Oct. 11, 1991

[86] PCT No.: PCT/EP91/01936

§ 371 Date: Apr. 15, 1993

§ 102(e) Date: Apr. 15, 1993

[87] PCT Pub. No.: WO92/07302

PCT Pub. Date: Apr. 30, 1992

[30] Foreign Application Priority Data

Oct. 19, 1990 [GB] United Kingdom ..... 9022781.0

[51] Int. Cl.[5] ..... G03D 3/02

[52] U.S. Cl. ..... 354/324

[58] Field of Search ..... 354/318-324; 134/64 P, 64 R, 122 P, 122 R

[56] References Cited

U.S. PATENT DOCUMENTS

| | | | |
|---|---|---|---|
| 3,983,934 | 10/1976 | Lee | 354/324 X |
| 3,986,191 | 10/1976 | Ackermann et al. | 354/324 X |
| 3,990,088 | 11/1976 | Takita | 354/298 |
| 4,104,668 | 8/1978 | Laar | 354/299 |
| 4,160,153 | 7/1979 | Melander | 219/485 |
| 4,182,567 | 1/1980 | Laar et al. | 354/324 X |
| 4,421,399 | 12/1983 | Steube | 354/324 X |
| 4,466,722 | 8/1984 | Staude | 354/319 X |
| 4,745,422 | 5/1988 | Matsuoka et al. | 354/324 X |
| 4,884,093 | 11/1989 | Bohmig | 354/324 |
| 4,888,608 | 12/1989 | Kummerl | 354/324 X |

FOREIGN PATENT DOCUMENTS

| | | |
|---|---|---|
| 64-44938 | 2/1989 | Japan . |
| WO91/12567 | 8/1991 | PCT Int'l Appl. . |
| 1268126 | 3/1972 | United Kingdom . |
| 1399481 | 7/1972 | United Kingdom . |
| 1403418 | 8/1975 | United Kingdom . |
| 1560572 | 2/1980 | United Kingdom . |

*Primary Examiner*—D. Rutledge

*Attorney, Agent, or Firm*—Frank Pincelli

[57] ABSTRACT

When using unstable processing solutions, high recirculation and/or replenishment rates may be required. However, when replenisher is added to a processing tank, a noticeable drop in the temperature of the processing solution may occur. Such a drop in temperature may lead to variable photographic sensitometry of the material being processed. Described herein is apparatus in which temperature control means (28) are provided to ensure that the temperature of the solution being added to the processing tank does not produce such a temperature drop.

4 Claims, 2 Drawing Sheets

PHOTOGRAPHIC PROCESSING APPARATUS

FIELD OF THE INVENTION

This invention relates to photographic processing apparatus and is more particularly concerned with maintaining the temperature of processing solutions within such apparatus.

BACKGROUND OF THE INVENTION

Conventional colour photographic silver halide materials are processed by a process which includes a colour development step. In this step silver halide is reduced to metallic silver in the light-exposed areas and the oxidised colour developer formed in this reaction then couples with a colour coupler and forms image dye. The amount of dye produced is proportional to the amount of silver halide reduced to metallic silver.

Redox amplification processes have been described, for example in British Patent Specifications GB-A-1268126, GB-A-1399481, GB-A-1403418 and GB-A-1560572. In such processes colour materials are developed to produce a silver image (which may contain only small amounts of silver) and then treated with a redox amplifying solution to form a dye image. The redox amplifying solution contains a reducing agent, for example a colour developing agent, and an oxidising agent which is more powerful than silver halide and which will oxidise the colour developing agent in the presence of the silver image which acts as a catalyst. Oxidised colour developer reacts with a colour coupler (usually contained in the photographic material) to form image dye. The amount of dye formed depends on the time of treatment or the availability of colour coupler rather than the amount of silver in the image as is the case in conventional colour development processes. Examples of suitable oxidising agents include peroxy compounds including hydrogen peroxide, cobalt (III) complexes including cobalt hexammine complexes, and periodates. Mixtures of such compounds can also be used.

Since the amplifying solution contains both an oxidising agent and a reducing agent it is inherently unstable. That is to say unlike a conventional colour developer solution, amplifier solutions will deteriorate in less than an hour even if left in a sealed container. The best reproducibility for such a process has been obtained by using a "one shot" system, where the oxidant is added to the developer and the solution mixed and used immediately (or after a short built in delay) and then discarded. This leads to the maximum solution usage possible with maximum effluent and maximum chemical costs. As a result the whole system is unattractive especially for a minilab environment where minimum effluent is required. It is believed that it is these shortcomings that have inhibited commercial use of this process.

Japanese Specification 64/44938 appears to describe such a system in which a silver chloride colour material is processed in a low volume of a single-bath amplifier solution. The processes described therein however fall short of what is required in the fully commercial environment for exactly the reasons given above.

Published International Patent Application WO-A-91/12567 (which corresponds to British Patent Application No. 9003282.2) describes a method and apparatus for photographic processing in which a minimum amount of processing solution can be used in a processing tank which is thin and has a low volume. In order to overcome the inherent deterioration problem due to the instability of the processing solutions used, the method and apparatus described result in the need for high recirculation and/or replenishment rates.

One difficulty with processing photographic material continuously in apparatus described in WO-A-91/12567 is that the heat capacity of the processing tank plus its contents is low when compared with normal processing tanks which contain tens of liters of processing solution. When a continuous web of photographic material is passed through the processing tank, a noticeable drop in temperature of the processing solution occurs. This temperature drop will depend on the temperature of the web. An additional drop in temperature is also observed when replenisher is added to the processing tank. In the case of a low volume processing tank, the replenisher forms a larger proportion of the total volume of the tank than normal. For a colour development stage, for example, variation in the processing solution temperature is undesirable and will lead to variable photographic sensitometry.

One solution to the above problem is to ensure that the photographic material and replenisher solutions are at the same temperature as the desired processing solution temperature in the processing tank. However, it may be difficult to do this in relation to the photographic material.

Another solution to the problem is to place the processing tank and its contents in a thermostatically controlled bath to maintain the desired temperature. This will be practicable if the heat transfer through the tank to the processing solution is high enough to give a constant temperature whether photographic material is being transported through the tank or not. However, this solution suffers from the problem of having to control the temperature of a large bath in order to maintain the processing tank and its contents at a constant desired temperature.

It is therefore an object of the present invention to provide apparatus and method which overcome the problems mentioned above.

SUMMARY OF THE INVENTION

According to one aspect of the present invention, there is provided photographic processing apparatus for processing photographic material, the apparatus comprising a low volume processing tank, recirculating means for recirculating processing solution through the processing tank, and replenishment means for replenishing the recirculating processing solution, characterized in that the apparatus further includes temperature control means through which the recirculating processing solution passes prior to reentering the processing tank, and in that the recirculating means are arranged so that the volume of the processing tank is recirculated between two and four times during the processing of the photographic material.

Advantageously, the temperature control means comprises a low volume heat exchanger. By low volume is meant low in relation to the volume of the processing tank. In the described embodiment, the heat exchanger has a volume of approximately 15 ml.

The ratio of the volume of the processing tank to the volume of the heat exchanger may be around 20:3.

For a better understanding of the present invention, reference will now be made, by way of example only, to the accompanying drawings in which:

DETAILED DESCRIPTION

Figure 1:
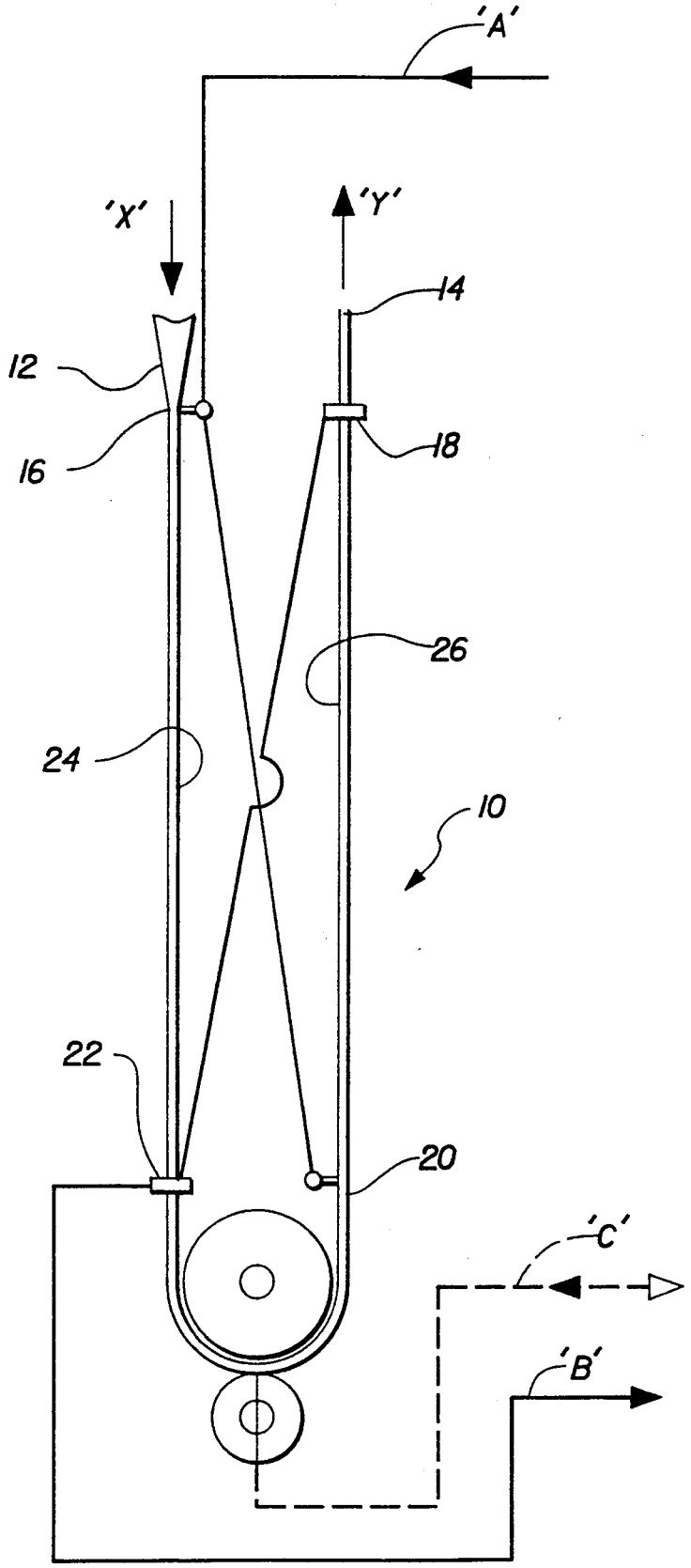
FIG. 1 is a schematic side elevation of a low volume tank.

Referring initially to FIG. 1, a low volume thin tank 10 is shown. Photographic material to be processed enters the tank 10 at inlet 12 (in the direction of arrow 'X') and leaves the tank at outlet 14 (in the direction of arrow 'Y'). Slots 16, 18, 20, 22 are formed in respective walls 24, 26 of the tank 10 through which processing solutions are circulated. Replenished processing solutions are pumped into the tank 10 at slots 16, 20 and used processing solutions are removed from the tank 10 at slots 18, 22.

The tank 10 has a width of 125 mm, a thickness of 1.5 mm and a path length of 550 mm between inlet 12 and outlet 14. This gives a tank volume of between approximately 100 to 150 ml. Typically, photographic material being processed passes through the tank 10 at a rate of approximately 25 $mms^{-1}$, and the processing solution in the tank is recirculated at a rate of 800 $mlmin^{-1}$. This means that the total tank volume is recycled completely between two and four times during the development time of the photographic material.

Figure 2:
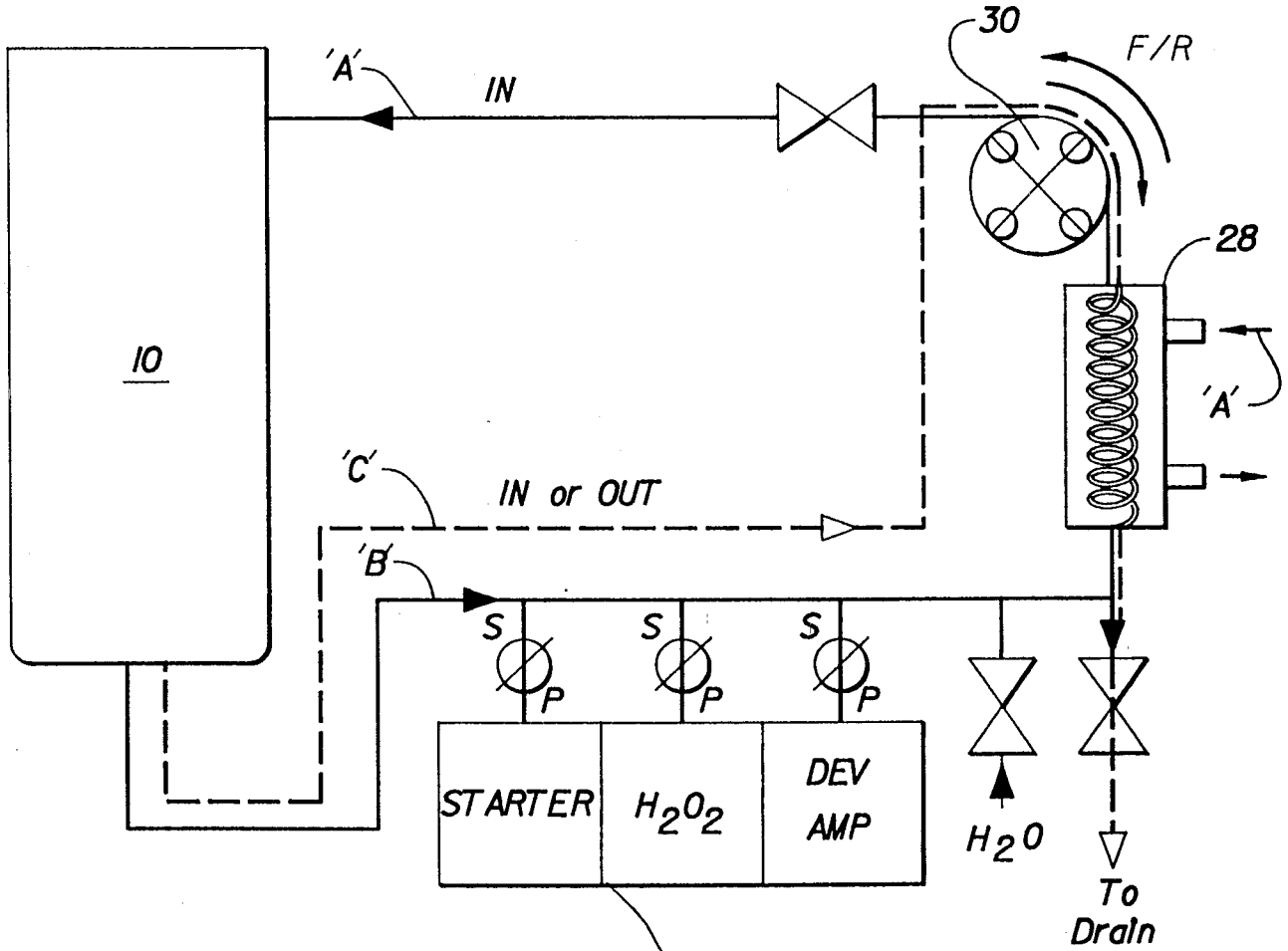
FIG. 2 is a schematic block diagram of processing apparatus according to the present invention incorporating a tank as shown in FIG. 1.

In FIG. 2, a schematic layout of apparatus according to the invention is shown. Parts previously described are referenced alike. The tank 10 is fluid flow connection with a heat exchanger 28, and a peristaltic pump 30. The heat exchanger 28 ensures that the processing solution being pumped into the tank 10 in flow path 'A' is at a constant temperature. Processing solution from the tank 10 is circulated to the heat exchanger 28 along flow path 'B'. The processing solution can be replenished as desired by adding starter solution, hydrogen peroxide or developer/amplifier solutions to the recirculating solution in path 'B'. As the replenisher solution is introduced into the recirculation loop which passes through the heat exchanger, it can be efficiently mixed and heated at the same time. Water can also be added as shown.

Flow path 'C' allows processing solution to be drained from the tank 10 and removed from the apparatus via a drain. In order to do this, the pump 30 is reversed to pump out the processing solution.

Flow path 'D' supplies heat to the heat exchanger 28 for supplying to the processing solution circulating through it. The liquid passing through the outside jacket of the heat exchanger, usually water, can be heated separately or can be diverted from another part of the processing apparatus.

Alternatively, the heat exchanger 28 can be heated directly using a thermostatically controlled electric heater in intimate contact with the inner coil. Control of the heating element could be by means of temperature sensors in the recirculation line or the processing tank itself.

Another alternative would be to place the electric heater directly in the path of the processing solution provided the heating element is not made of a material which would react with the chemicals used in the processing solutions.

Various valves are present in the apparatus to allow solutions to be pumped from one place to another at an appropriate time in the processing cycle. These valves, the heat exchanger 28, the pump 30, and the replenishment materials, shown generally at 32, are all controlled by a microprocessor (not shown).

The pump 30 and all the pipework operate on low volumes so that the total volume of the system is kept to a low acceptable minimum level. An acceptable volume for the heat exchanger 28 is 15 ml compared to a tank volume of 100 ml.

Because the solution temperature control is stable irrespective of the transport of photographic material through the tank 10, more consistent sensitometry is observed. Using apparatus as described above, acceptable sensitometry was maintained on continuous and intermittent operation over lengths of material of 3.96 m (13 ft)—approximately 0.51 $m^2$ (5.5 $ft^2$)—indicating that satisfactory replenishment and temperature control was achieved.

The heat exchanger can be positioned in the same thermostatic bath as the processing tank (not shown). In this case, heat can be directly supplied to the outer surfaces of the heat exchanger coil. Good circulation across the coil surface would be necessary. Alternatively, the processing tank could be made of good heat conducting material and could have fins for transferring heat. However, good recirculation would still be required.

A hydrodynamically designed mixing spiral could be used, for example a KENIC coil (ex Kenic Corporation, USA), which would perform the dual purpose of a heat exchanger and a very efficient solution mixing method A concentrated replenisher could then be mixed efficiently with the contents of the tank and heated as it was introduced into the recirculation loop.

We claim:

1. Photographic processing apparatus for processing photographic material, the apparatus comprising a low volume processing tank, recirculating means for recirculating processing solution through the process tank, and replenishment means for replenishing the recirculating processing solution, characterized in that the apparatus further includes temperature control means through which the recirculating processing solution passes prior to re-entering the processing tank, and in that the recirculating means are arranged so that the volume of the processing tank is recirculated between two and four times during the processing of the photographic material.

2. Apparatus according to claim 1, wherein the temperature control means comprises a heat exchanger with a volume low in relation to the volume of the processing tank.

3. Apparatus according to claim 2, wherein the heat exchanger has a volume of approximately 15 ml.

4. Apparatus according to claim 3, wherein the ratio of the volume of the processing tank to the volume of the heat exchanger is approximately 20:3.

* * * * *

UNITED STATES PATENT AND TRADEMARK OFFICE

CERTIFICATE OF CORRECTION

PATENT NO. : 5,319,410

DATED : June 7, 1994

INVENTOR(S) : E.C.T.S. Glover, et al

It is certified that error appears in the above-indentified patent and that said Letters Patent is hereby corrected as shown below:

In column 4, line 44, delete "process" and insert --processing--.

Signed and Sealed this

Sixth Day of September, 1994

*Attest:*

*Attesting Officer*

BRUCE LEHMAN

*Commissioner of Patents and Trademarks*